US009033034B2

(12) United States Patent
Angelle et al.

(10) Patent No.: US 9,033,034 B2
(45) Date of Patent: May 19, 2015

(54) WEAR SENSOR FOR A PIPE GUIDE

(75) Inventors: Jeremy Richard Angelle, Lafayette, LA (US); Robert Thibodeaux, Lafayette, LA (US); John Erick Stelly, Breaux Bridge, LA (US)

(73) Assignee: Frank's International, LLC, Houston, TX (US)

( * ) Notice: Subject to any disclaimer, the term of this patent is extended or adjusted under 35 U.S.C. 154(b) by 228 days.

(21) Appl. No.: 13/331,790

(22) Filed: Dec. 20, 2011

(65) Prior Publication Data

US 2013/0153213 A1 Jun. 20, 2013

(51) Int. Cl.

| | |
|---|---|
| ***E21B 19/00*** | (2006.01) |
| ***E21B 19/24*** | (2006.01) |
| ***E21B 19/07*** | (2006.01) |
| ***E21B 19/06*** | (2006.01) |

(52) U.S. Cl.

CPC ..... *E21B 19/24* (2013.01); *E21B 19/07* (2013.01); *E21B 19/06* (2013.01); *E21B 19/00* (2013.01)

(58) Field of Classification Search

CPC ..... E21B 19/00; E21B 19/07; E21B 19/06; E21B 19/24

USPC ..... 166/250.01, 379, 380, 77, 1, 77.51, 166/77.52, 77.53, 85.5; 175/70, 423; 414/22.68, 22.71; 294/102.2

See application file for complete search history.

(56) References Cited

U.S. PATENT DOCUMENTS

| | | | | |
|---|---|---|---|---|
| 5,101,896 | A | 4/1992 | Thompson et al. | |
| 5,526,877 | A | 6/1996 | Winz | |
| 5,642,793 | A * | 7/1997 | Ljøsne | 192/30 W |
| 6,059,052 | A | 5/2000 | Haggard | |
| 7,762,343 | B2 * | 7/2010 | Sonneveld et al. | 166/382 |
| 8,028,750 | B2 * | 10/2011 | Hughes et al. | 166/250.01 |
| 2008/0035333 | A1 | 2/2008 | Newman | |
| 2010/0116558 | A1 | 5/2010 | Angelle et al. | |

OTHER PUBLICATIONS

International Search Report and Written Opinion issued in Application No. PCT/US2012/070500, dated Apr. 26, 2013 (18 pages).

* cited by examiner

*Primary Examiner* — Jennifer H Gay
*Assistant Examiner* — George Gray
(74) *Attorney, Agent, or Firm* — Osha Liang LLP

(57) ABSTRACT

A system to grip a tubular member and sense wear for a pipe handling apparatus including the pipe handling apparatus having a bore formed therein with an axis defined therethrough, a pipe guide disposed adjacent to an opening of the bore of the pipe handling apparatus, and a wear sensor coupled to the pipe guide.

24 Claims, 2 Drawing Sheets

WEAR SENSOR FOR A PIPE GUIDE

BACKGROUND OF DISCLOSURE

1. Field of the Disclosure

Embodiments disclosed herein generally relate to methods and apparatuses to sense wear for a pipe guide. More specifically, embodiments disclosed herein relate to an apparatus that is used to sense wear for a pipe guide, such as a pipe guide disposed adjacent to a pipe handling apparatus.

2. Background Art

Wells are drilled into the earth's crust and completed to establish a fluid conduit between the surface and a targeted geologic feature, such as a formation bearing oil or gas. Pipe strings used to drill or complete a well may be made-up and run into a drilled borehole. A casing string may be cemented into a targeted interval of a drilled borehole to prevent borehole collapse, to prevent formation fluid cross-flow, and/or to isolate the interior of the well from corrosive geologic fluids.

Generally, a pipe string may be disposed and suspended within a borehole from a drilling rig using a pipe handling apparatus, such as a spider, in which the pipe string may be lengthened step-wise by threadably joining a tubular segment to the proximal end of the pipe string at the rig. The pipe string may be suspended within the drilling rig using a second type of pipe handling apparatus, such as an elevator, that is movably supported from a draw works and a derrick above the spider. As the load of the pipe string is transferred between the spider and the elevator, the spider may be unloaded and then disengaged from the pipe string by retraction of the slips within the spider. The lengthened pipe string may then be lowered further into the borehole using the draw works controlling the elevator. The spider may then again engage and support the pipe string within the borehole and an additional tubular segment may be joined to the new proximal end of the pipe string to further lengthen the pipe string.

As such, lengthening a pipe string generally involves adding one tubular segment at a time to an existing pipe string. Similarly, reducing the length of a pipe string generally involves a reverse process in which one tubular segment at a time is removed from the existing pipe string. Accordingly, each tubular member disposed downhole and returned back uphole from the well may pass through and be handled by one or more pipe handling apparatuses, such as the spider and/or the elevator. However, after handling a large number of tubular segments and supporting the weight of the pipe string, one or more components of the pipe handling apparatuses may require maintenance to ensure that the pipe handling apparatuses are working properly and will continue to work properly.

As such, to reduce the wear on a pipe handling apparatus, a pipe guide may be disposed adjacent to one or both of the openings of the pipe handling apparatus to ensure that the tubular members being received within the pipe handling apparatus are in proper alignment and position. While, the pipe guides themselves may be subject to wear, such as from hard-banding, misalignments, hang-ups while disposed tubular members downhole or pulling them back uphole, etc, it may be easier to inspect and replace a pipe guide, as compared to inspecting and replacing the entire pipe handling apparatus.

For example, a pipe guide may be disposed adjacent to the top opening and/or the bottom opening of a spider, in which the pipe guides may be replaced as needed. For the top pipe guide of the spider, a visual inspection of the pipe guide may be enough to determine if the top pipe guide needs replacing. However, it may be more complicated to determine if the bottom pipe guide requires replacing, as the bottom pipe guide may be disposed below the rig floor such that visual inspection may be difficult, or impossible for that matter. Accordingly, there exists a need that may address these concerns, such as to more adeptly accommodate the need to replace a pipe guide and/or other components of a pipe handling apparatus when visual inspection may be otherwise impaired.

SUMMARY OF INVENTION

In one aspect, embodiments disclosed herein relate to a system to grip a tubular member. The system includes a pipe handling apparatus having a bore formed therein with an axis defined therethrough, a pipe guide disposed adjacent to an opening of the bore of the pipe handling apparatus, and a wear sensor coupled to the pipe guide.

In another aspect, embodiments disclosed herein relate to a method to manufacture an apparatus to sense wear for a pipe handling apparatus. The method includes connecting a pipe guide to a base, the base configured to be connected to the pipe handling apparatus, and coupling a wear sensor to the pipe guide, the wear sensor configured to determine a predetermined amount of wear for the pipe guide.

In another aspect, embodiments disclosed herein relate to a method to sense wear within a pipe guide disposed adjacent to a pipe handling apparatus. The method includes guiding a tubular member into the pipe handling apparatus with the pipe guide, and sensing with a wear sensor coupled to the pipe guide that the pipe guide has received a predetermined amount of wear.

In yet another aspect, embodiments disclosed herein relate to a system to grip a tubular member. The system includes means for handling the tubular member, means for guiding the tubular member into the handling means, the guiding means disposed adjacent to an opening of the handling means, and means for sensing wear of the guiding means, the sensing means coupled to the guiding means.

Other aspects and advantages of the invention will be apparent from the following description and the appended claims.

DETAILED DESCRIPTION

Figure 1:
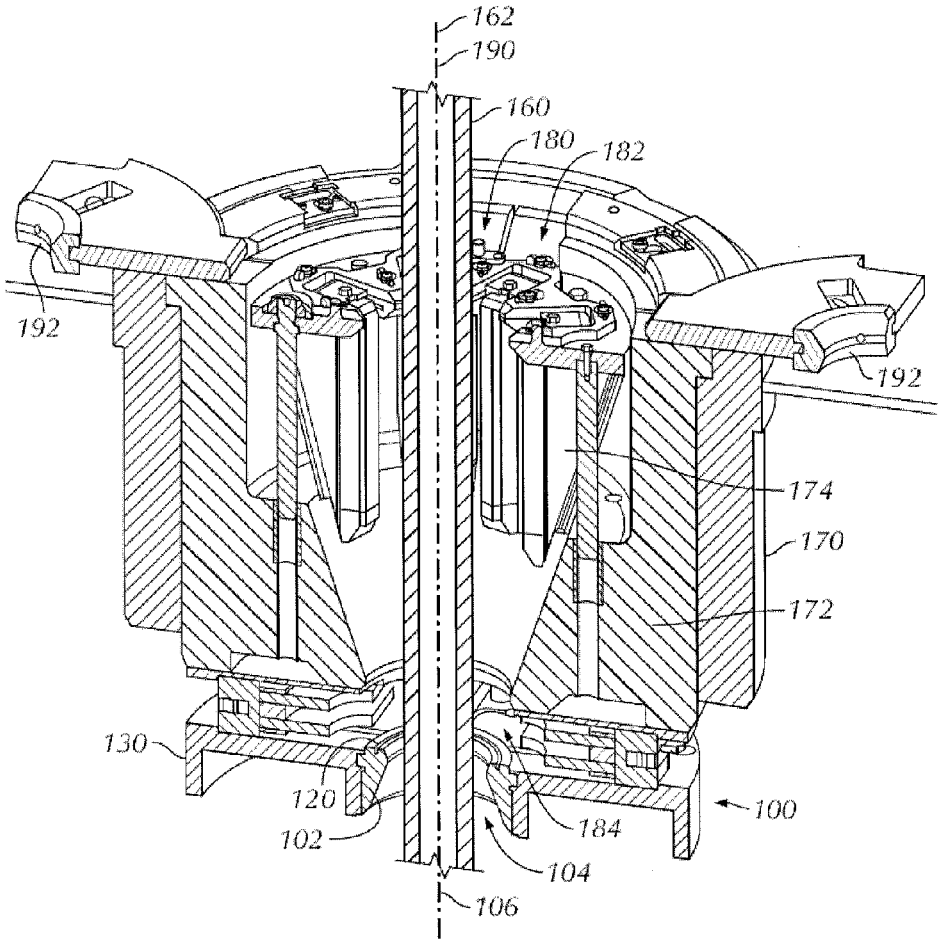
FIG. 1 shows a perspective sectional view of an apparatus connected to a pipe handling apparatus in accordance with one or more embodiments disclosed herein.

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

Furthermore, those having ordinary skill in the art will appreciate that when describing connecting a first element to a second element, it is understood that connecting may be either directly connecting the first element to the second element, or indirectly connecting the first element to the second element. For example, a first element may be directly connected to a second element, such as by having the first element and the second element in direct contact with each other, or a first element may be indirectly connected to a second element, such as by having a third element, and/or additional elements, connected between the first and second elements.

Additionally, directional terms, such as "above," "below," "upper," "lower," "top," "bottom," etc., are used for convenience in referring to the accompanying drawings. In general, "above," "upper," "upward," "top," and similar terms refer to a direction toward the earth's surface from below the surface along a borehole, and "below," "lower," "downward," "bottom," and similar terms refer to a direction away from the surface along the borehole, i.e., into the borehole, but is meant for illustrative purposes only, and the terms are not meant to limit the disclosure.

In one aspect, embodiments disclosed herein relate to a system, an apparatus, and/or a method to sense wear within a pipe guide and/or within a pipe handling apparatus. The apparatus includes a pipe guide that has a wear sensor coupled thereto. The pipe guide may be disposed adjacent to an opening of a pipe handling apparatus, in which the pipe guide with the wear sensor may be disposed adjacent to an opening of the pipe handling apparatus. The wear sensor may be any sensor known in the art, such as a mechanical sensor, a pneumatic sensor, a hydraulic sensor, and/or an electrical sensor. However, as shown below, the wear sensor may be a pneumatic sensor, in which the sensor may include flexible tubing having pressurized gas therein. As such, the wear sensor may be disposed within a groove of the pipe guide, in which wear sensor may indicate that a predetermined level of wear has been reached within the pipe guide when the wear sensor has been punctured and has loss of pressure for the pressurized gas.

Referring now to FIG. 1, a perspective sectional view of an apparatus 100 connected to a pipe handling apparatus 170 in accordance with one or more embodiments disclosed herein is shown. In this embodiment, the pipe handling apparatus 170 may be a spider, in which the pipe handling apparatus 170 may include a bowl 172 with one or more slip assemblies 174 movably connected to the bowl 172. The slip assemblies 174 may move within the pipe handling apparatus 170 between an open position and a closed position to handle and grip a tubular member 160.

Accordingly, the pipe handling apparatus 170 may include a bore 180 formed therein about an axis 190, in which the bore 180 defines a first opening 182 (e.g., a top opening) and a second opening 184 (e.g., a bottom opening) for the pipe handling apparatus 170. As such, the axis 190 for the pipe handling apparatus 170 may substantially align with an axis 162 for the tubular member 160, such as when the slip assemblies 174 are in the closed position to handle and grip the tubular member 160. Those having ordinary skill in the art, however, will appreciate that the present disclosure contemplates that other pipe handling apparatuses may be used besides a spider, such as an elevator, without departing from the present disclosure.

Referring still to FIG. 1, the apparatus 100 includes a pipe guide 102 disposed adjacent to the pipe handling apparatus 170. Specifically, in this embodiment, the pipe guide 102 may be disposed adjacent to the second opening 184 of the pipe handling apparatus 100. As shown, the pipe guide 102 may have a bore 104 formed therein about an axis 106, in which the axis 106 for the pipe guide 102 may substantially align with the axis 190 for the pipe handling apparatus 170. The pipe guide 102 may be formed from any material known in the art, such as wearable material, including any metal or metal alloy known in the art. As such, the pipe guide 102 may be used to guide the tubular member 160 into the pipe handling apparatus 170, such as when the tubular member 160 is entering and/or exiting through the second opening 184 of the pipe handling apparatus 170.

Further, an additional, second pipe guide 192 may be disposed adjacent to the first opening 182 of the pipe handling apparatus 170. The second pipe guide 192 may be movable between an open position, as shown in FIG. 1, and a closed position. As such, in the closed position, the pipe guide 192 may be used to guide the tubular member 160 into the pipe handling apparatus 170, such as when the tubular member 160 is entering and/or exiting through the first opening 182 of the pipe handling apparatus 170.

As the pipe guide 102 is formed from a wearable material, the pipe guide 102 may include a wear sensor 120 coupled thereto. A wear sensor in accordance with the present disclosure may be used to measure an amount of wear that has occurred within a pipe guide, such as particularly indicating when a predetermined amount of wear for the pipe guide has been reached. As such, and as shown in FIG. 1, the wear sensor 120 may be used to sense and indicate when a predetermined amount of wear has been reached for the pipe guide 102, in which the pipe guide 102 may then need to be refurbished and/or replaced.

Referring still to FIG. 1, to have the pipe guide 102 disposed adjacent to the pipe handling apparatus 170, the pipe guide 102 may be connected to a base 130, in which the base 130 may then be connected to the pipe handling apparatus 170. The pipe guide 102 may also be removably connected to the base 130, as the pipe guide 102 may be need to be replaced, as desired, or at intervals indicated by the wear sensor 120.

Figure 2A:
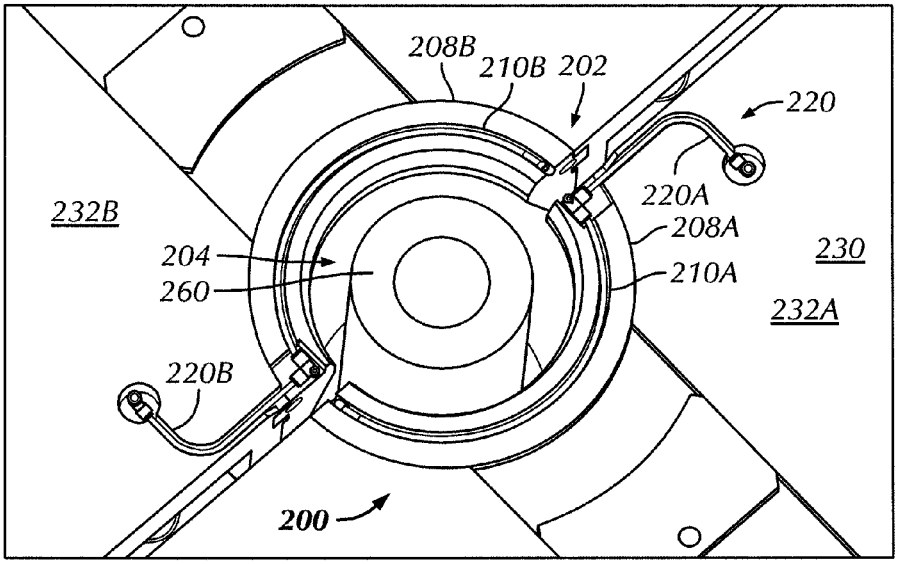
FIGS. 2A and 2B show multiple views of an apparatus in accordance with one or more embodiments disclosed herein.
Figure 2B:
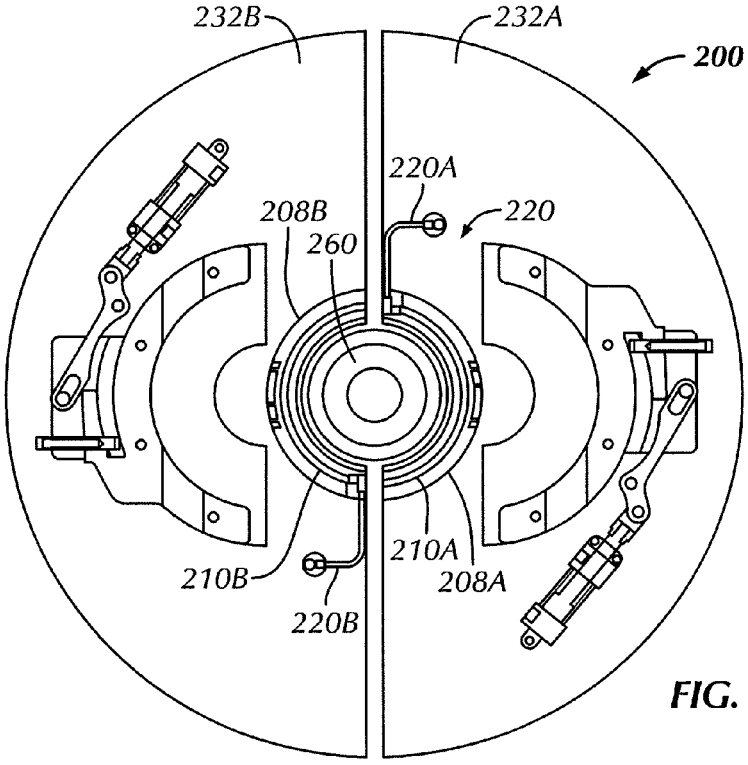

Referring now to FIGS. 2A and 2B, multiple views of an apparatus 200 in accordance with one or more embodiments disclosed herein are shown. FIG. 2A provides a perspective detailed view of the apparatus 200, and FIG. 2B provides a top down view of the apparatus 200. As discussed above, the apparatus 200 includes a pipe guide 202 connected to a base 230. As such, in this embodiment, the pipe guide 202 may include a first pipe guide section 208A and a second pipe guide section 208B. The first pipe guide section 208A and the second pipe guide section 208B may be used to guide the tubular member 260 into a pipe handling apparatus. Those having ordinary skill in the art will appreciate that more than two sections may be used in accordance with embodiments disclosed herein, such as by having the apparatus formed of at least three sections.

The first pipe guide section 208A and/or the second pipe guide section 208B may be connected, such as removably connected, to the base 230, in which the base 230 may then be connected to a pipe handling apparatus. As shown in FIGS. 2A and 2B, the base 230 may include a first base section 232A and a second base section 232B. However, those having ordinary skill in the art will appreciate that the base may include more than two sections, or alternatively may be formed of a single structure. In the embodiment shown in FIGS. 2A and 2B, the first pipe guide section 208A may be removably connected to the first base section 232A, and the second pipe guide section 208B may be removably connected to the second base section 232B.

As mentioned above, the pipe guide 202 includes a wear sensor 220 coupled thereto, in which the wear sensor 220 may be used to sense wear in the pipe guide 202. As such, in this embodiment, as the pipe guide 202 may include the first pipe guide section 208A and the second pipe guide section 208B, a first wear sensor 220A may be coupled to the first pipe guide section 208A, and a second wear sensor 220B may be coupled to the second pipe guide section 208B.

As shown in FIGS. 2A and 2B, the first pipe guide section 208A may have a groove 210A formed therein, in which the first wear sensor 220A may be disposed, at least partially, within the groove 210A. As such, in selected embodiments, the first wear sensor 220A may comprise flexible tubing containing a pressurized gas therein and configured to fit within the groove 210A of the first pipe guide section 208A. Similarly, the second pipe guide section 208B may have a groove 210B formed therein, in which the second wear sensor 220B may be disposed, at least partially, within the groove 210B. As such, the second wear sensor 220B may comprise flexible tubing containing a pressurized gas therein and configured to fit within the groove 210B of the first pipe guide section 208B.

Accordingly, as the pipe guide 202 wears from guiding tubular members 260 into a pipe handling apparatus, the wear may eventually erode the first pipe guide section 208A from the bore 204 towards the groove 210A and/or erode the second pipe guide section 208B from the bore 204 towards the groove 210B. Once the pipe guide sections 208A and 208B erode to the grooves 210A and 210B, the tubular member 260 may then be in direct contact with the first wear sensor 220A and/or the second wear sensor 220B.

As the tubular member 260 contacts the wear sensors 220A and/or 220B, the tubular member 260 may wear the wear sensors 220A and/or 220B such that the flexible tubing may rupture. As the flexible tubing may have pressurized gas therein, the pressure of the gas within the wear sensors 220A and/or 220B may be monitored, such as having the wear sensors 220A and/or 220B coupled to a control panel, to determine that the flexible tubing has ruptured and pressurized gas is leaking therefrom, and therefore the pipe guide 202 may need replacing. Specifically, in the embodiment shown in FIGS. 2A and 2B, the first wear sensor 220A may be used to indicate that the first pipe guide section 208A needs to be replaced, and the second wear sensor 220B may be used to indicate that the second pipe guide section 208B needs to be replaced.

As shown and discussed above, the wear sensor may be a pneumatic sensor, such that the gas pressure in the sensor is monitored to determine and sense the wear that has occurred within the pipe guide. However, those having ordinary skill in the art will appreciate that the wear sensor may be any sensor known in the art, such as a mechanical sensor, a magnetic sensor, a different pneumatic sensor, a hydraulic sensor, and/or an electrical sensor.

For example, in one embodiment, an electrical sensor may be disposed and/or included within the pipe guide, in which the electrical wear sensor may similarly indicate when a tubular member has made contact with the electrical wear sensor. In such an embodiment, the electrical wear sensor may be monitored, and when the wear sensor contacts the tubular member, such as if an electrical current passes from the electrical wear sensor to the tubular member, the wear sensor may indicate that the pipe guide needs to be replaced. As such, the present disclosure contemplates other arrangement and configurations for a wear sensor to measure and/or otherwise indicate that a predetermined amount of wear has occurred within the pipe guide.

Those having ordinary skill in the art will appreciate that FIGS. 2A and 2B show the apparatus 200 including two pipe guide sections 208A and 208B, two base sections 232A and 232B, and two wear sensors 220A and 220B, those having ordinary skill in the art that the present disclosure is not so limited. Specifically, an apparatus in accordance with the present disclosure may include one or more pipe guide sections, one or more base sections, and/or one or more wear sensors, independent of how many sections are included for other components of the apparatus. For example, though an apparatus in accordance with the present disclosure may include three pipe guide sections, the apparatus may only need to include one wear sensor. Accordingly, the present disclosure contemplates other configurations and arrangements for an apparatus to sense wear that may not be shown in FIGS. 1, 2A, and 2B.

An apparatus in accordance with one or more embodiments of the present disclosure may be useful in multiple areas of drilling. For example, as the apparatus may be disposed adjacent to a pipe handling apparatus, the apparatus may be used to sense wear within a pipe guide and indicate when the pipe guide may need to be replaced. In one embodiment, the apparatus may be disposed adjacent to a bottom side and a bottom opening of a pipe handling apparatus, as the bottom opening of a pipe handling apparatus having a pipe guide may be difficult to visually inspect and verify that the pipe guide is in proper working condition. As such, an apparatus in accordance with the present disclosure may be used and disposed adjacent to the bottom side of the pipe handling apparatus to sense and indicate to a user when a pipe guide may need to be replaced. Further, as the pipe guide includes sections that are removably connected within the apparatus, the sections may be replaced at a desired rate and/or as needed. For example, as the pipe guide sections include a wearable material, the sections may need to be removed and replaced regularly, depending on use.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A system to grip a tubular member, the system comprising: a pipe handling apparatus having a bore formed therein with an axis defined therethrough~ the pipe handling apparatus comprising a first pipe handling section and a second pipe handling section; a base directly connected to a second opening of the pipe handling apparatus, the base having a bore formed therein with an axis defined therethrough; a first pipe guide connected to the base, the first pipe guide disposed within the bore of the base; and a wear sensor coupled to the first pipe guide, wherein the base comprises a first base section and a second base section, wherein the first pipe guide comprises a first pipe guide section and a second pipe guide section, wherein each of the first pipe guide section and the second pipe guide section is continuous through a swept angle of about 180° when the sections are separated, wherein the first pipe guide section is connected to the first base section and the second pipe guide section is connected to the second base section, wherein a second pipe guide is disposed adjacent a first opening of the pipe handling apparatus, wherein the second pipe guide is movable separately independently from the first pipe handling section and the second pipe handling section of the pipe handling apparatus between an open position and a closed position.

2. The system of claim 1, wherein the base is disposed directly adjacent to a bottom surface of the pipe handling apparatus.

3. The system of claim 1, wherein:

the first pipe guide has a bore formed therein and an axis defined therethrough;

the second pipe guide has a bore formed therein and an axis defined therethrough; and the axis of the pipe handling apparatus aligns with the axis of each of the first pipe guide and the second pipe guide.

4. The system of claim 1, wherein the first pipe guide is removably connected to the base.

5. The system of claim 1, wherein:

the wear sensor comprises a first wear sensor and a second wear sensor;

the first wear sensor is coupled to the first pipe guide section; and the second wear sensor is coupled to the second pipe guide section.

6. The system of claim 1, wherein the wear sensor comprises at least one of a mechanical sensor, a pneumatic sensor, a hydraulic sensor, and an electrical sensor.

7. The system of claim 1, wherein:

the first pipe guide comprises a groove formed therein; and the wear sensor is disposed within the groove of the first pipe guide.

8. The system of claim 7, wherein the wear sensor comprises flexible tubing having pressurized gas therein.

9. The system of claim 1, wherein the first pipe guide comprises a wearable metal material.

10. The system of claim 1, wherein the pipe handling apparatus comprises a bowl having a plurality of slip assemblies movably connected thereto.

11. The system of claim 1, wherein the second pipe guide comprises a first pipe guide section and a second pipe guide section.

12. A method to manufacture an apparatus to sense wear for a pipe handling apparatus, the method comprising: connecting a base directly to an end surface of the pipe handling apparatus, wherein the pipe handling apparatus has a bore formed therethrough, wherein the base has a bore formed therein with an axis defined therethrough, wherein the base comprises a first base section and a second base section; connecting a first pipe guide to the base, wherein the first pipe guide is disposed within the bore of the base, wherein the first pipe guide comprises a first pipe guide section and a second pipe guide section, wherein each of the first pipe guide section and the second pipe guide section is continuous through a swept angle of about 180° when the sections are separated, and wherein the first pipe guide section is connected to the first base section and the second pipe guide section is connected to the second base section; and coupling a wear sensor to the first pipe guide, the wear sensor configured to determine a predetermined amount of wear for the first pipe guide.

13. The method of claim 12, wherein the wear sensor comprises a first wear sensor and a second wear sensor, and wherein the coupling the wear sensor to the first pipe guide comprises:

coupling the first wear sensor to the first pipe guide section; and coupling the second wear sensor to the second pipe guide section.

14. The method of claim 12, further comprising:

forming a groove within the first pipe guide; and disposing the wear sensor within the groove of the first pipe guide.

15. The method of claim 14, wherein the wear sensor comprises flexible tubing having pressurized gas therein.

16. A method to sense wear within a first pipe guide disposed adjacent to a pipe handling apparatus, the method comprising: guiding a tubular member into the pipe handling apparatus with the first pipe guide, wherein the pipe handling apparatus has a bore formed therethrough, wherein the first pipe guide is connected to a base, the base being directly connected to an end surface of the pipe handling apparatus and having a bore formed therein, wherein the first pipe guide is disposed within the bore of the base, wherein the base comprises a first base section and a second base section, wherein the first pipe guide comprises a first pipe guide section and a second pipe guide section, wherein each of the first pipe guide section and the second pipe guide section is continuous through a swept angle of about 180° when the sections are separated, wherein the first pipe guide section is connected to the first base section and the second pipe guide section is connected to the second base section; and sensing with a wear sensor coupled to the first pipe guide that the first pipe guide has received a predetermined amount of wear.

17. The method of claim 16, wherein the wear sensor comprises flexible tubing having pressurized gas therein, wherein the sensing with the wear sensor comprises:

monitoring pressurized gas within the flexible tubing; and rupturing the flexible tubing of the wear sensor with the tubular member, thereby having pressurized gas leaks out from within the flexible tubing.

18. The method of claim 17, wherein the flexible tubing is disposed within a groove formed within the first pipe guide.

19. The method of claim 16, further comprising:

replacing the first pipe guide with an additional pipe guide.

20. The method of claim 16, wherein the wear sensor comprises a first wear sensor and a second wear sensor, wherein the sensing with the wear sensor comprises at least one of:

sensing with the first wear sensor coupled to the first pipe guide section that the first pipe guide section has received a predetermined amount of wear; and sensing with the second wear sensor coupled to the second pipe guide section that the second pipe guide section has received a predetermined amount of wear.

21. A system to grip a tubular member, the system comprising: a pipe handling apparatus that receives the tubular member; a base disposed directly on an end surface of the pipe handling apparatus, the base having a bore formed therein with an axis defined therethrough, wherein the base comprises a first base section and a second base section; a first pipe guide that guides the tubular member into the pipe handling apparatus, the first pipe guide disposed within the bore of the base, wherein the first pipe guide comprises a first pipe guide section and a second pipe guide section, wherein each of the first pipe guide section and the second pipe guide section is continuous through a swept angle of about 180° when the sections are separated, and wherein the first pipe guide section is connected to the first base section and the second pipe guide section is connected to the second base section; and a wear sensor that senses wear of the first pipe guide, the wear sensor coupled to the first pipe guide.

22. The system of claim 21, wherein:

the pipe handling apparatus comprises a bore formed therein and an axis defined therethrough;

the first pipe guide comprises a bore formed therein and an axis defined therethrough; and the axis of the pipe handling apparatus aligns with the axis of the first pipe guide.

23. The system of claim 21, wherein:

the first pipe guide comprises a groove formed therein;

the wear sensor comprises flexible tubing having pressurized gas therein; and the flexible tubing is disposed within the groove of the first pipe guide.

24. The system of claim 21, wherein:

the wear sensor comprises a first wear sensor and a second wear sensor;

the first wear sensor is coupled to the first pipe guide section; and the second wear sensor is coupled to the second pipe guide section.

* * * * *

UNITED STATES PATENT AND TRADEMARK OFFICE

CERTIFICATE OF CORRECTION

PATENT NO. : 9,033,034 B2
APPLICATION NO. : 13/331790
DATED : May 19, 2015
INVENTOR(S) : Jeremy Richard Angelle et al.

It is certified that error appears in the above-identified patent and that said Letters Patent is hereby corrected as shown below:

IN THE CLAIMS

At column 6, Lines 61-62 the words "movable separately independently from" should read -- movable independently from --.

Signed and Sealed this
Third Day of November, 2015

Michelle K. Lee

Michelle K. Lee
*Director of the United States Patent and Trademark Office*